United States Patent [19]

Bryant

[11] 4,438,611

[45] Mar. 27, 1984

[54] STUD FASTENERS AND WALL STRUCTURES EMPLOYING SAME

[75] Inventor: George E. Bryant, Renton, Wash.

[73] Assignee: W. R. Grace & Co., Cambridge, Mass.

[21] Appl. No.: 364,079

[22] Filed: Mar. 31, 1982

[51] Int. Cl.[3] ..... E04B 2/30; E04B 2/40

[52] U.S. Cl. ..... 52/309.2; 52/359; 52/410

[58] Field of Search ..... 52/309.7, 410, 489, 52/354, 483, 359-363, 483, 775, 309.2

[56] References Cited

U.S. PATENT DOCUMENTS

| | | | |
|---|---|---|---|
| Re. 28,976 | 9/1976 | Zinn . | |
| 1,389,866 | 9/1921 | Georgeson et al. . | |
| 1,562,784 | 11/1925 | Olsen . | |
| 1,662,177 | 3/1928 | Williams . | |
| 1,963,416 | 6/1934 | Minshall . | |
| 2,780,850 | 2/1957 | Lieff | 52/359 |
| 2,898,258 | 8/1959 | Meier et al. . | |
| 3,073,421 | 1/1963 | Bock | 52/775 |
| 3,171,232 | 3/1965 | Gretter . | |
| 3,401,494 | 9/1968 | Anderson | 52/309.2 |
| 3,445,975 | 5/1969 | Nelsson . | |
| 3,525,189 | 8/1970 | Nelsson . | |
| 3,948,011 | 4/1976 | Price et al. | 52/511 |
| 4,127,975 | 12/1978 | Judkins . | |
| 4,245,448 | 1/1981 | Agar | 52/DIG. 6 |
| 4,377,060 | 3/1983 | Ragland . | |

*Primary Examiner*—James L. Ridgill, Jr.

*Attorney, Agent, or Firm*—John J. Wasatonic; William L. Baker

[57] ABSTRACT

The present invention is directed to improved fasteners for securing insulation to a supporting structure, to a method of using the fasteners, and to combination wall structures obtained by such use. The fasteners are adapted to facilitate the securement of relatively thick insulation to a supporting structure, particularly where the supporting structure consists of a relatively hard material, such as aged concrete of high compressive strength.

24 Claims, 6 Drawing Figures

STUD FASTENERS AND WALL STRUCTURES EMPLOYING SAME

BACKGROUND OF THE INVENTION

This invention relates to fasteners for securing insulation to walls. More particularly, this invention pertains to improved fasteners which facilitate the securing of relatively thick insulation to walls and which also facilitate the securing of insulation to walls which are relatively hard and difficult to penetrate.

U.S. Pat. No. 3,401,494 relates to a method of securing sheets of insulating polystyrene foam between gypsum panels and concrete walls and to the resultant composite wall structure. The method and resultant wall structure utilize metal fasteners which, in preferred form, are channel shaped and have serrated legs depending from an elongated web. The fasteners are pressed into the polystyrene foam and the resultant assembly is secured to the concrete wall by nails or pins driven thorugh the fastener and polystyrene and into the concrete wall. The fastener allows the foam to be secured to the wall without appreciable deformation of the material. Gypsum paneling is then attached to the metal fastener by the use of regular screws employed for such purpose.

Although the fasteners described in the patent provide advantages and have proven to be commercially useful, they do not provide an altogether satisfactory means of attaching rigid or semi-rigid insulation members to a supporting structure. In this regard, it should be recognized that the polystyrene boards, as well as most other types of rigid or semi-rigid insulation members which can be used in conjunction with the fasteners, are formed of relatively soft materials which do not provide support to the pin or nail as it is being driven through the insulation member and into the supporting wall. This lack of lateral support along the length of the nail as a driving force is being applied can result in bending or buckling of the nail. In addition, since the nail is also unsupported at the intended point of entry into the wall, there is a tendency for the nail to deflect or "skip" on the surface of the wall and, thus, to contact the wall at an oblique angle rather than at the desired 90°angle. As a result, reliable and consistent penetration of the nail into the wall are not always achieved.

The severity of the above-described difficulties generally increases with the increasing insulation thickness, inasmuch as the longer nails which are required have a greater tendency to bend or buckle. The difficulties are also more severe and occur with greater frequency where the supporting wall is hard and difficult to penetrate. For example, in retrofitting old concrete walls, compressive strengths of 5000 psi or greater can be encountered. With such walls, satisfactory penetration with unsupported fastening nails can be particularly difficult to achieve.

SUMMARY OF THE INVENTION

The present invention is directed to improved fasteners for the securing of insulation to a support structure, to a method of using the improved fasteners, and to combination wall structures obtained by such use. The fasteners of this invention are adapted to permit securement of an insulation member to a supporting structure using short pins or nails which do not traverse the insulation but, rather, are driven through the fastener and directly into the supporting structure. Bending or deflection of the pin or nail is thus minimized and the thickness of the insulation is immaterial to the ability or effectiveness of the pin or nail in providing a satisfactory attachment. The fasteners provide a reliable and consistent means of securing the insulation and are especially useful in providing reliable attachment to supporting structures which are not easily penetrated by fastening pins or nails, such as aged concrete walls of high compressive strength or concrete walls containing a high concentration of hard aggregates.

The fasteners of this invention are also adapted to minimize thermal conduction across the secured insulation. Accordingly, they can be used to fabricate wall structures and systems having a high level of thermal performance.

The improved fasteners of this invention comprise a substantially flat elongated strip having at least one leg depending therefrom, an arm joined with and extending out from the elongated strip, and an L-shaped member depending from the arm and having substantially flat first and second legs set at a right angle to one another. The first leg of the L-shaped member depends from the arm at substantially a right angle and the second leg extends out from the first leg in a direction away from the elongated strip.

The fasteners of this invention are constructed so that when the elongated strip and dependent leg(s) are properly aligned and engaged with the front surface of an insulation member the arm extends at least to an edge of the insulation, the first leg of the L-shaped member extends along the side of the insulation and is closely adjacent thereto, and the second leg extends outwardly from the side of the insulation member and is essentailly coplanar with its back surface. In accordance with the method aspects of this invention, the back surface of the insulation member and the second leg are placed against a supporting structure and pins, nails, rivets, or other attaching means are driven through the second leg and into the supporting structure, thereby securing the fastener and insulation member to the structure.

The present invention is more fully presented in the following detailed description taking in connection with the accompanying drawings.

DETAILED DESCRIPTION OF THE INVENTION

As noted above, the arm of the present fasteners is joined with the elongated strip. This is intended as a broad characterization of the relation between these elements. Included within its meaning is any suitable engagement, connection, or attachment of the arm and elongated strip, as well as the arm and strip being formed as a unitary and continuous structure without any joint or attachment, per se between them. The arm, or a member comprising the arm, can be fixedly joined with the strip by means such as rivets, welds, adhesives, and the like, or it can be loosely joined therewith by, for example, compressive contact or insertion of a projection of one of the elements into an aperture in the other.

The arm of the present fasteners can be in the form of a substantially flat, coplanar extension of the elongated strip. Alternatively, the arm can be provided by a member which is superposed in part with the elongated strip and extends in part outwardly therefrom. The superposed member can be joined with the strip by any of the means noted above and preferably is loosely engaged therewith by insertion of a tab depending from the member into an aperture provided in the elongated strip.

The arm can extend longitudinally or, preferable, transversely from the elongated strip. In general, the fastener contains a plurality of arms, and dependent L-shaped members, spaced along the length of the elongated strip. A sufficient number are provided to insure satisfactory attachment to the supporting structure. It should be recognized that heat transfer across the fastener is minimized by using a plurality of spaced L-shaped members, rather than a continuous L-shaped member extending the length of the fastener.

Figure 1:
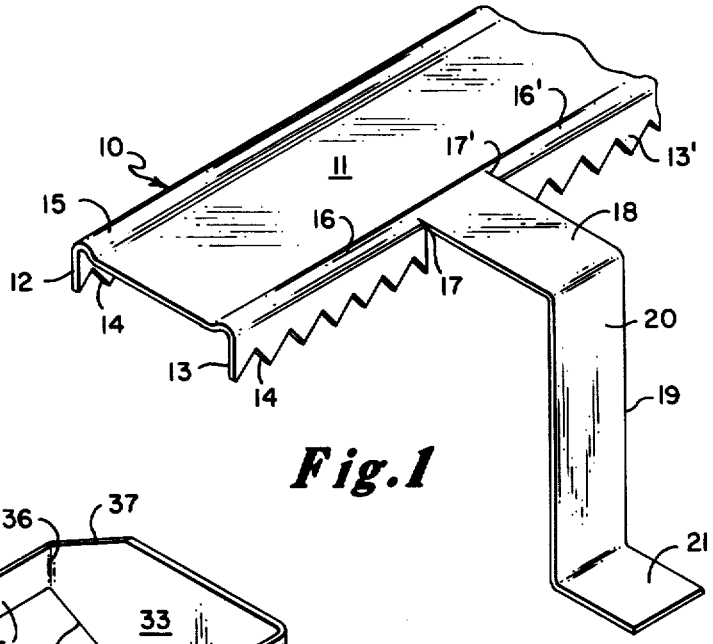
FIG. 1 is a perspective view of one embodiment of a fastener of this invention.

Referring to FIG. 1, there is shown a section of a fastener of this invention wherein the arm component is a flat coplanar extension of the elongated strip. The fastener 10 comprises a substantially flat elongated strip 11, a continuous leg 12 depending at a substantially right angle from one of the lengthwise edges of strip 11 and terminating in a serrated edge 14, and a discontinuous leg comprising spaced apart segments 13 and 13' depending at substantially a right angle from the other lengthwise edge of strip 11 and also terminating in a serrated edge 14. At the corner defined by the juncture of leg 12 with strip 11 is formed a convex corner bead 15 while at the corners defined by the juncture of leg segments 13 and 13' with strip 11 there are formed a corresponding series of corner beads 16 and 16'. The corner beads provide additional rigidity and strength to the fastener.

The elements 11 through 16' form a stud member or stud segment which is especially well adapted to engage insulation which is in the form of a rigid sheet. The legs 12, 13, and 13' can be pressed into the insulation sheet to bring the underside of strip 11 into a substantially contiguous, face-to-face relation with the surface of the sheet. The penetration of the legs into the insulation engages the insulation such that attachment of the fastener to a supporting structure firmly holds the insulation in place against the structure.

The fastener 10 is also shown to comprise an arm 18 which extends transverse to and is a coplanar extension of strip 11. A plurality of such arms (not shown) can be provided at intervals along the length of the fastener and specifically at each of the gaps between the spaced apart leg segments of the discontinuous leg, e.g., as shown between segments 13 and 13'. Thus, leg segment 13 and corner bead 16 terminate at corner 17 while leg segment 13' and corner bead 16' terminate at corner 17'. Depending from arm 18 is an L-shaped member 19 comprising a substantially flat first leg 20 and a substantially flat second leg 21 set at a right angle to leg 20.

In utilizing the fastener 10, the legs of the stud member are pressed into an insulation member (not shown) adjacent an edge thereof and spaced from that edge a distance equal to the length of arm 18. The leg 20 thus extends along the side of the insulation member and is closely adjacent thereto. The length of the leg 20 is substantially equal to the width of the side of the insulation such that the second leg 21 is essentially coplanar with the "back" of the insulation. The second leg 21 and the back surface of the insulation member are placed against a supporting structure and leg 21 is attached by suitable means to the supporting structure. The fastener and insulation member are thus secured to the supporting structure. Suitable means for attaching leg 21 to the supporting structure include pins, nails, screws, rivets, and the like which are driven through the leg and into the supporting structure. The length and width of leg 21 are not critical, except that they should be sufficient to permit the use of desired means of driving the pin, nail, etc., such as, for example, a pneumatic or powder-actuated hammer.

Fastener 10 is illustrated as being formed without any joints or connections, per se, between its respective elements. Thus, in addition to arm 18 being a coplanar continuation of stip 11, the legs 20 and 21 are illustrated as angular continuations of arm 18. This construction is consistent with the fabrication of the fastener from a single, continuous piece or sample of stock material such as by stamping or cutting an appropriate profile from a flat piece of stock material, e.g., a ductile metal, and thereafter forming the various elements of the fastener by working the resultant flat profile. Alternatively, the fastener 10 could be fabricated by molding techniques, e.g., molding of a plastic stock material.

Figure 2:
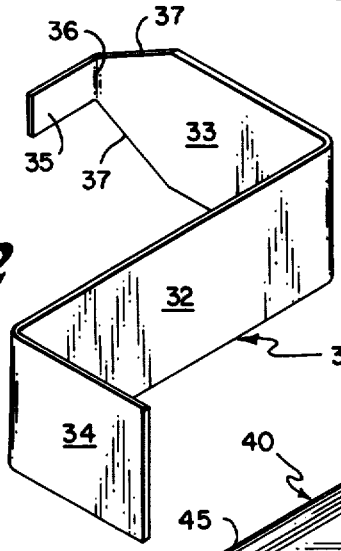
FIG. 2 is a perspective view of a bracket which can be engaged with a stud member to provide a fastener of this invention.

In FIG. 2, there is shown a bracket 31 which can be used in assembling a preferred fastener of this invention. The bracket 31 comprises a planar web 32, planar first and second legs 33 and 34, respectively, depending at substantially a right angle and in opposite directions from the respective ends of web 32, and a projection of first leg 33 in the form of a substantially flat tab 35 depending from first leg 33 on the same side thereof as web 32. Leg 33 is shown to have tapering sides 37 beginning at an arbitrary point along its length and tapering from a first to a second, narrower, width, with tab 35 depending from leg 33 at the terminus 36 of the tapering sides. The bracket 31 can be engaged with a stud member as shown in FIG. 3 to construct a preferred fastener of this invention.

Figure 3:
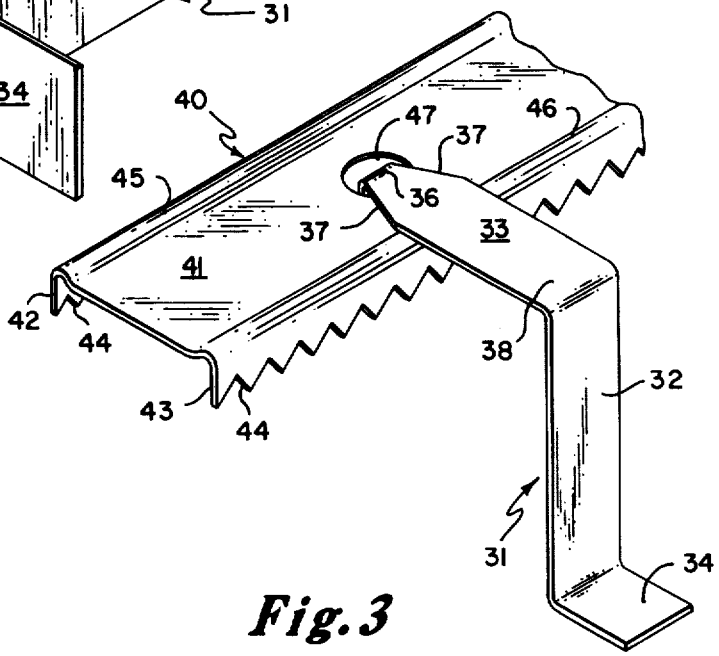
FIG. 3 is a perspective view of a preferred fastener assembly for this invention.

FIG. 3 illustrates a preferred fastener of this invention constructed by engagement of bracket 31 with a stud member 40. The stud member 40 has a preferred channel-shaped configuration and comprises a substantially flat elongated strip 41 and a pair of continuous legs 42 and 43 depending at substantially a right angle from the lengthwise edges of strip 41 and terminating in serrated edges 44. At the corners formed by the juncture of legs 42 and 43 with strip 41 are formed a pair of convex corner beads 45 and 46 which, as with fastener 10 in FIG. 1, provide additional rigidity and strength to the fastener. A circular aperture 47 is provided in strip 41. The stud member 40 comprises a series of such apertures (not shown) spaced along its length.

Figure 6:
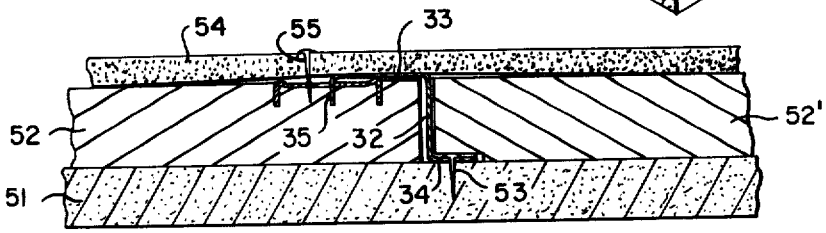
FIG. 6 is a cross-sectional view of a combination wall structure of this invention.

Bracket 31 is shown in loose engagement with stud 40 by means of insertion of tab 35 into aperture 47. The relative dimensions of tab 35 and aperture 47 are such that the tab can be readily inserted into the fastener in a loose fashion and without becoming bound or fixed in the aperture. The dimensions of aperture 47 are sufficiently close to those of tab 35, however, to prevent substantial positional displacement of the bracket in the strip 41 after insertion of tab 35. The relative dimensions of tab 35 and strip 41 are such that tab 35 extends below the strip and, generally, penetrates the surface of the insulation material engaged by the fastener, e.g. as shown in FIG. 6.

FIG. 3 illustrates that a part of first leg 33 is superposed with strip 41 and that the remaining part extends transversely from the strip and provides an arm segment, designated as 38, which effectively displaces web 32 and leg 34 from stud 40. In use, the stud 40 is pressed into an insulation member at a predetermined distance from the edge thereof, such that when bracket 31 is engaged with the stud the outward extension of arm segment 38 terminates at the edge of the insulation and web 32 extends along the side of the insulation and is closely adjacent thereto. The length of web 32 substantially equal to the width of the insulation member such that second leg 34 extends essentially coplanar with the back surface of the insulation. Utilization of fastener 40 in this manner is illustrated in FIGS. 4 and 5.

Figure 4:
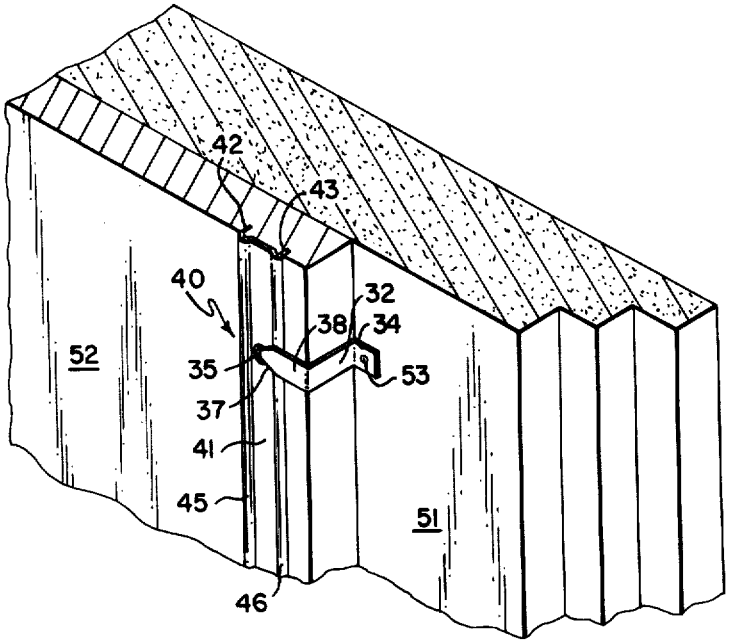
FIG. 4 is an elevational view of a combination wall structure of this invention constructed using the preferred fastener of FIG. 3.
Figure 5:
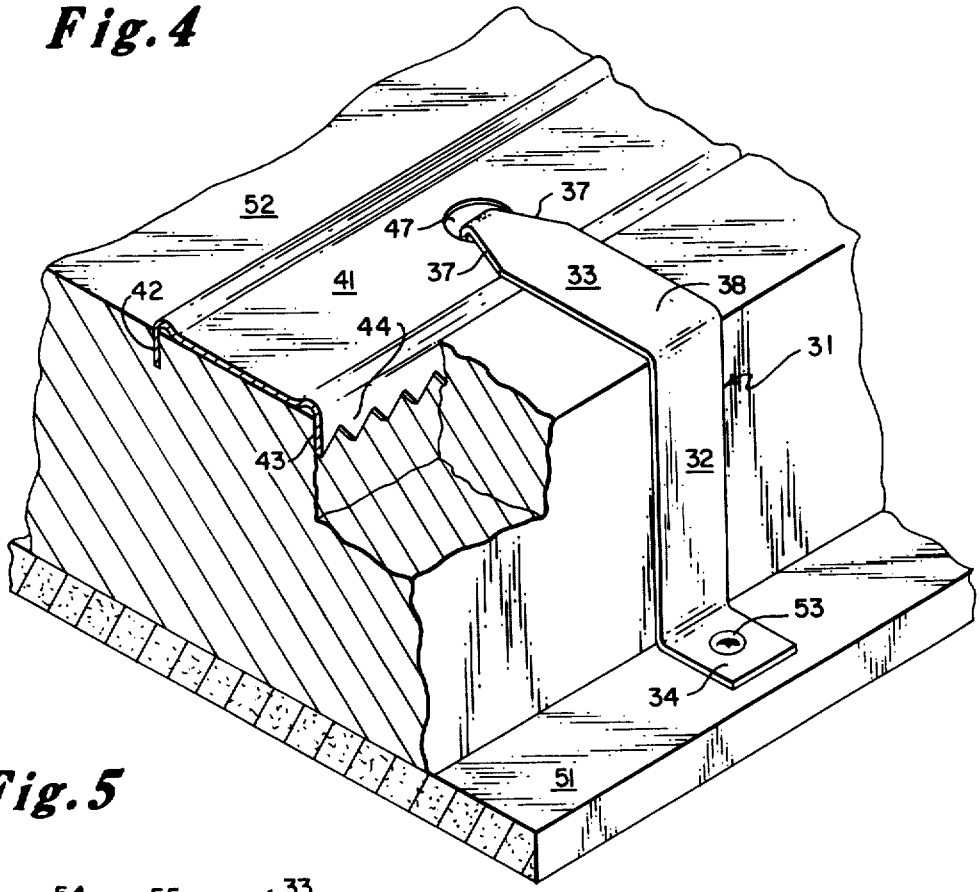
FIG. 5 is a cut-away section view of the wall structure of FIG.4.

FIG. 4 provides an elevational view of a wall structure of this invention constructed using the preferred fastener of FIG. 3 . The FIGURE shows an insulation member 52, in the form of a rigid sheet, secured to a concrete wall 51 by the preferred fastener. The stud member 40 is shown pressed into insulation sheet 52 at a predetermined distance from the edge of the sheet and extending parallel to the edge. Arm segment 38 extends outwardly to the edge of sheet 52 and web 32 extends closely adjacent to the side of sheet 52. Web 32 extends for the width of the insulation member such that second leg 34 is coplanar with the back surface of the insulation. Sheet 52 and fastener 40 are secured to wall 51 by a pin or nail 53 extending through second leg 34 and into wall 51.

The web 32 and second leg 34 will be seen to comprise an L-shaped member depending from arm segment 38. Provision of the L-shaped member and arm in a bracket which can be engaged with a stud member provides flexibility and economy in that a single type of stud member can be employed without regard to the thickness of the insulation. The stud member is thereafter engaged with a bracket which is appropriate for the insulation width. Further flexibility and economy are provided in that an operator is allowed discretion in employing the minimum number of brackets necessary to provide satisfactory attachment, thus allowing savings in materials cost and minimizing heat transfer from interior to exterior walls.

The insulation sheet may be provided with grooves to facilitate proper alignment of the stud member.

FIG. 5 provides another view of the wall structure of FIG. 4 with a portion of sheet 52 cut away. FIG. 5 provides a more detailed view of the penetration and engagement of sheet 52 by legs 42 and 43. Generally, the penetration of the legs is about ¼ to about ½ inch. This depth of penetration is normally sufficient to provide satisfactory engagement of the insulation member, regardless of its thickness.

In constructing the wall structure of FIGS. 4 and 5 in accordance with this invention, the stud 40 is pressed into the front surface of insulation sheet 52, the back surface of the sheet is positioned against the wall 51, the bracket 31 is brought into engagement with stud 40 by inserting tab 35 into aperture 47, and pin or nail 53 is driven through leg 34 into the wall. Leg 34 may be "pre-drilled," if desired, to facilitate placement of pin or nail 53 and penetration of same into the wall. Insertion of tab 35 into aperture 47 serves to position the bracket prior to attachment to the wall and results in a "locking" effect which provides reliable engagement with the stud.

Although certain preferred embodiments of this invention have been described with reference to a bracket having an insertable tab and a stud adapted to receive that tab, it is within the present invention to employ similar brackets without an insertable tab which are engaged with the stud by other means such as spot welds, rivets, adhesives, or compressive contact wherein the compressive force is provided by the attachment to the supporting structure. Engagement by such means would, of course, obviate apertures in the stud.

Although stud 40 is illustrated as having a circular aperture, it will be recognized that the shape of the aperture is not critical and it may be provided in other forms such as a rectangular slot.

FIG. 6 provides, in exaggerated and non-proportional dimensions, an edge-on view of the wall assembly of FIGS. 4 and 5 having secured thereto an overlying sheet-like panel 54. Panel 54 can be constructed of, for example, gypsum or a wood or plastic composite. The panel is shown secured to stud 40 by a screw 55. A plurality of screws (not shown) is employed along the length of panel 54 and stud 40 to firmly secure the panel to the stud and, thus, to the supporting wall 51. As illustrated, the screws have a length less than the thickness of panel 54 and insulation sheet 52 so that they do not contact wall 51.

Tab 35 is shown to extend through the strip 41 and into insulation sheet 52. Penetration of the insulation by the tab can provide a more secure engagement of bracket 31 with stud member 40, particularly where the insulation sheet is comprised of a foam-like material, e.g., polystyrene foam, which has sufficient resiliency to grasp the tab and hold the bracket in place.

FIG. 6 also shows a second insulation sheet 52' abutting sheet 52. A wall structure of this invention will normally comprise a series of such abutting sheets so as to contain an insulation covering which is essentially coextensive with the supporting wall. Sheet 52' is secured to wall 51 by one or more fasteners of this invention (not shown) positioned adjacent to the abutting edge of sheet 52' shown in FIG. 6 and/or positioned adjacent to the opposite edge of sheet 52'. Sheet 52' is shown to extend over leg 34 and to be separated from sheet 52 by a distance essentially equal to the thickness of web 32. However, since web 32 and leg 33 are formed of relatively thin strips, perferably of about 40 mil thickness, the separation between the abutting sheets and between the sheet and supporting wall is generally not appreciable.

The fasteners illustrated in FIG. 1 and FIGS. 3-6 have the L-shaped member depending from the terminus of the outwardly extending arm and the arm thus terminates at the edge of the insulation member. However, the fasteners of this invention can be constructed to have the arm extend beyond the edge of the insulation, i.e., the L-shaped member depends from an intermediate point on the arm, so as to extend the arm over an abutting insulation member. The extenstion of the arm over the abutting insulation member can aid in retaining that member against the supporting structure.

If desired, a rigid insulation sheet secured to a supporting structure by a fastener of this invention may be further secured to the structure on its interior portions using other fastener systems known for such purposes, e.g. those of previously referenced U.S. Pat. No. 3,401,494.

It is within the scope of this invention to employ the present fasteners to secure insulation to the exterior surface of a supporting structure as well as the interior surface. Use in the insulation of ceilings and floors is also contemplated. While the present invention has been described primarily in terms of a solid, continuous support structure such as a concrete or cinder block wall, it is within the contemplation of this invention to employ the fasteners hereof in conjunction with "discontinuous" support structures such as an assemblage of wood or metal studs.

The fasteners of this invention are especially well adapted for the engagement and attachment of thermal insulation in the form of a rigid, frangible foam board or sheet, e.g., a polystyrene or polyurethane board. However, the fasteners can also be used for engagement and attachment of other types of rigid or semi-rigid thermal insulation materials.

As indicated above, the preferred fasteners of this invention comprise channel-shaped stud members having dependent continuous or discontinuous legs terminating in serrated edges. The stud members may comprise leg element(s) in other forms, however, and the leg elements may be specifically adapted to engage a particular type of insulation. The leg element(s) may, for example, comprise sections punched out of interior segments of the flat elongated strip of the stud at spaced intervals. The punched out sections would depend from the strip at substantially a right angle and be pressed into the insulation in much the same manner as the serrated legs illustrated herein. Adaption of leg elements to engage a particular insulation material can include, for example, provisions of barbs or hooks capable of engaging a fibrous insulation material.

The fasteners of this invention are preferably formed of galvanized metal, although other materials such as plastic or wood may be employed.

The width of the elongated strip of the stud section of the fasteners should be sufficent to provide an adequate load-bearing surface for attachment of gypsum, wood-composite, or other covering materials thereto. Generally, a width of about 1 inch to 2 inches is preferred. The length of the elongated strip is generally approximately equal to the length of the insulation segment. A satisfactory width for the outwardly extending arm and dependent L-shaped member is generally on the order of about ½ to 1½ inch.

As used herein, the term "supporting structure" refers to any wall, stud assemblage, or other structure which provides a site for attachment of the present fasteners and thus supports the fastener and the insulation engaged thereby.

What is claimed is:

1. A fastener comprising a substantially flat elongated strip having at least one leg depending therefrom, an arm joined with and extending out from said elongated strip, and an L-shaped member comprising substantially flat first and second legs, said first leg depending from said arm and said second leg extending out from said first leg and away from said elongated strip, said first leg and each of said legs depending from said elongated strip being on the same side of said elongated strip.

2. A fastener of claim 1 wherein said arm is provided by a substantially flat member superposed in part with said elongated strip and extending in part outwardly from said elongated strip.

3. A fastener of claim 2 wherein said substantially flat member extends transverse to said elongated strip and is joined with said strip by insertion of a projection of said arm into an aperture in said strip.

4. A fastener of claim 2 comprising two continuous legs depending at substantially a right angle from the respective lengthwise edges of said elongated strip and terminating in serrated edges.

5. A fastener of claim 4 further comprising convex corner beads formed at the corners defined by the respective junctures of said continuous legs with said elongated strip.

6. A fastener of claim 1 wherein said arm comprises a substantially flat coplanar extension of said elongated strip.

7. A fastener of claim 6 comprising a continuous leg depending at substantially a right angle from a lengthwise edge of said elongated strip and a discontinuous leg comprising spaced leg segments depending at substantially a right angle from the other lengthwise edge of said elongated strip, said arm transversely extending from said strip between said spaced leg segments.

8. A fastener of claim 7 comprising convex corner beads formed at corners defined by the respective junctions of said continuous leg and said leg segments with said elongated strip.

9. A fastener of claim 8 wherein said continuous leg and said leg segments terminate in serrated edges.

10. A fastener comprising, in combination:

a stud member comprising a substantially flat elongated strip having at least one leg depending therefrom and having at least one aperture in its surface; and a bracket comprising (a) a planar web, (b) substantially flat first and second legs depending from opposite ends of said web at substantially a right angle and in opposite directions, and (c) a tab depending from said first leg on the same side thereof as said web;

said tab extending into said aperture with said first leg in part transversely superposed with said strip and in part transversely extending out from said strip so as to provide a substantially flat arm segment from which said web depends.

11. A fastener of claim 10 wherein said first leg has a first width and sides tapering along at least part of its length and terminating at a narrower second width and said tab depends from said first leg at the terminus of said tapering sides.

12. A fastener of claim 10 wherein said stud member is channel-shaped and comprises two continuous legs depending at substantially a right angle from the respective lengthwise edges of said elongated strip and terminating in serrated edges.

13. A fastener of claim 12 further comprising a pair of convex corner beads formed at the corners defined by the respective junctures of said continuous legs with said elongated strip.

14. A wall structure comprising, in combination:

a wall or wall-stud assembly;

an insulation member having front and back surfaces, said back surface facing said wall or wall-stud assembly;

at least one fastener engaging said insulation member and attached to said wall or wall-stud assembly, said fastener comprising (a) a substantially flat elongated strip in substantially contiguous face-to-face relation with said front surface of said insulation member and having at least one leg depending therefrom and penetrating said front surface, (b) an arm joined with and extending out from said elongated strip at least to an edge of said insulation member, and (c) an L-shaped member comprising substantially flat first and second legs, said first leg depending from said arm thereto and extending closely adjacent to a side surface of said insulation member, said first leg being equal in length to the width of said side surface, and said second leg extending away from said side surface on that side of said first leg opposite said arm and contiguous with a portion of said wall or wall-stud assembly; and means attaching said second leg to said wall or wall-stud assembly.

15. A wall structure of claim 14 wherein said means attaching said second leg to said wall or wall-stud assembly comprises a pin or nail extending through said second leg and into said wall or wall-stud assembly.

16. A wall structure of claim 14 further comprising a sheet-like panel overlying said front surface of said insulation member and secured to said fastener.

17. A wall structure of claim 16 wherein said panel is a gypsum panel which is attached to said fastener by screw extending through said gypsum panel and said elongated strip.

18. A wall structure of claim 14 wherein said arm is provided by a substantially flat member superposed in part with said elongated strip and extending in part outwardly from said elongated strip.

19. A wall structure of claim 18 wherein said substantially flat member extends transverse to said elongated strip and is joined with said strip by insertion of a projection of said arm into aperture in said strip.

20. A wall structure of claim 19 wherein said fastener comprises two continuous legs depending at substantially a right angle from the respective lengthwise edges of said elongated strip and terminating in serrated edges.

21. A wall structure of claim 14 wherein said insulation member is in the form of a rigid sheet.

22. A wall structure of claim 21 wherein said insulation sheet is secured to a wall constructed of concrete or cinder blocks.

23. A wall structure of claim 21 wherein said rigid sheet is a polystyrene sheet.

24. A bracket adapted for engagement with a stud member, said stud member comprising a substantially flat elongated strip having at least one leg depending therefrom and having an aperture in its surface, said bracket comprising (a) a planar web, (b) substantially flat first and second legs depending from opposite ends of said web in opposite directions, said first leg having a first width and sides tapering along at least part of its length and terminating at a narrower second width, and (c) a tab depending at substantially a right angle from said first leg at the terminus of said tapering sides and on the same side of said first leg as said planar web, said bracket being adapted for engagement with said stud member by insertion of said tab in said aperture.

* * * * *